US006577824B2

(12) United States Patent
Itoh et al.

(10) Patent No.: US 6,577,824 B2
(45) Date of Patent: Jun. 10, 2003

(54) APPARATUS AND METHOD FOR SUPPLYING NEW AND RECOVERED TONER TO A DEVELOPING DEVICE

(75) Inventors: Shinichi Itoh, Yokohama (JP); Tetsuo Katoh, Kunitachi (JP); Tatsuyuki Miura, Yokohama (JP); Seiji Tsuzuki, Kawaguchi (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/976,147

(22) Filed: Oct. 15, 2001

(65) Prior Publication Data

US 2003/0072592 A1 Apr. 17, 2003

(51) Int. Cl.[7] ..... G03G 15/08; G03G 21/10

(52) U.S. Cl. ..... 399/27; 399/258; 399/259; 399/359

(58) Field of Search ..... 399/27, 29, 30, 399/58, 59, 61–63, 358–360, 253–256, 258, 260, 259

(56) References Cited

U.S. PATENT DOCUMENTS 4,260,073 A * 4/1981 Baumann ..... 399/359 X
5,737,680 A * 4/1998 Takagaki et al. ..... 399/359
6,192,212 B1 * 2/2001 Kunihiro et al. ..... 399/253
6,226,490 B1 * 5/2001 Fujita et al. ..... 399/359

FOREIGN PATENT DOCUMENTS

JP 2000-267366 9/2000

* cited by examiner

*Primary Examiner*—William J. Royer
(74) *Attorney, Agent, or Firm*—Foley & Lardner

(57) ABSTRACT

An image forming apparatus and method cause a connecting/conveying device to convey a recovered toner from a cleaner part to a recovered toner housing to house therein the recovered toner, and cause a control device to separately control a recovered toner supply device and a new toner supply device to supply the recovered toner, which is stored in the recovered toner housing, and/or a new toner, which is stored in a new toner housing, to a developing device. The control device restricts the supply of the recovered toner from the recovered toner housing to the developing device when a no-residual-amount detecting device detects no residual amount of the new toner in the new toner housing.

10 Claims, 12 Drawing Sheets

APPARATUS AND METHOD FOR SUPPLYING NEW AND RECOVERED TONER TO A DEVELOPING DEVICE

TECHNICAL BACKGROUND

The present invention generally relates to an apparatus and method for forming an image, and is capable of being applied to an image forming apparatus and method, which utilize toner of a copying machine or printer having a photosensitive drum.

In an image forming apparatus and method utilizing toner, there is carried out an image forming process for electrifying minus charges on the surface of a photosensitive drum, exposing (varying the surface potential of) the photosensitive drum to laser beams based on picture signals to form a latent image, causing the photosensitive drum to absorb minus charged toner to form a visible image, and transferring and fixing the visible image on a paper.

In such image formation, a toner (which will be hereinafter referred to as a "recovered toner") which has been already utilized in image formation, and a toner (which will be hereinafter referred to as a "new toner") which has not yet been utilized in image formation, are mixed to be utilized. That is, the recovered toner is recycled to be used.

Conventionally, as a method for recycling a recovered toner, there is a method for conveying a recovered toner, which leaves a cleaner auger, to a developing device by means of a connecting auger, which connects the cleaner auger to the developing device, and returning the recovered toner directly into the developing device. In this method, the rotation of the cleaner auger must be in synchronism with the rotation of the photosensitive drum, and the rotation of the connecting auger to the developing device must be connected with the cleaner auger.

If a toner specific concentration sensor provided in the developing device is utilized for carrying out a toner empty display, which is carried out when the new toner is completely consumed, and/or for carrying out the stop of an image forming operation due to toner empty when the developer toner specific concentration decreases to a predetermined toner specific concentration, even if the new toner is completely consumed in a cartridge or hopper, the supply of toner recovered from the cleaner part continues, so that the percentage of the recovered toner in the developing device increases.

An external additive is peeled from the recovered toner, and paper powder is mixed in the recovered toner. Therefore, even if the recovered toner is supplied into the developing device, the rise of the quantity of electrification is worse than that in the case of the new toner. For that reason, the percentage of the recovered toner increases to be larger than the usual percentage, so that image fogging tends to occur.

SUMMARY OF THE INVENTION

It is an object of the present invention to prevent an image having image fogging from being formed when a new toner is completely consumed in a cartridge or hopper.

In order to accomplish the aforementioned object, according to the present invention, an image forming apparatus comprises: recovered toner housing means for temporarily storing therein a recovered toner; a connecting/conveying device for conveying the recovered toner from a cleaner part to the recovered toner housing means; recovered toner supply means for supplying the recovered toner, which is housed in the recovered toner housing means, to a developing device; new toner housing means for housing therein a new toner; new toner supply means for supplying the new toner, which is stored in the new toner housing means, to the developing device; no-residual-amount detecting means for detecting no residual amount of the new toner in the new toner housing means; and control means for separately controlling the recovered toner supply means and the new toner supply means, to cause the recovered toner or the new toner to be supplied to the developing device, wherein the control means restricts the supply of the recovered toner from the recovered toner housing means to the developing device when the no-residual-amount detecting means detects no residual amount of the new toner.

In order to accomplish the aforementioned object, according to the present invention, there is provided an image forming method for causing a connecting/conveying device to convey a recovered toner from a cleaner part to the recovered toner housing means to house therein the recovered toner, and causing control means to separately control the recovered toner supply means and the new toner supply means to supply the recovered toner, which is stored in the recovered toner housing means, and/or a new toner, which is stored in the new toner housing means, to the developing device, wherein the control means restricts the supply of the recovered toner from the recovered toner housing means to the developing device when the no-residual-amount detecting means detects no residual amount of the new toner in the new toner housing means.

BEST MODE FOR CARRYING OUT THE INVENTION

The preferred embodiment of an image forming apparatus and method utilizing toner according to the present invention will be described below. In the following description, it is assumed that a copying machine is provided with a preferred embodiment of an image forming apparatus according to the present invention.

The image forming apparatus is incorporated in a copying machine for forming and transferring an image on a paper by the reversal development system on the basis of the original to be copied.

Figure 1:
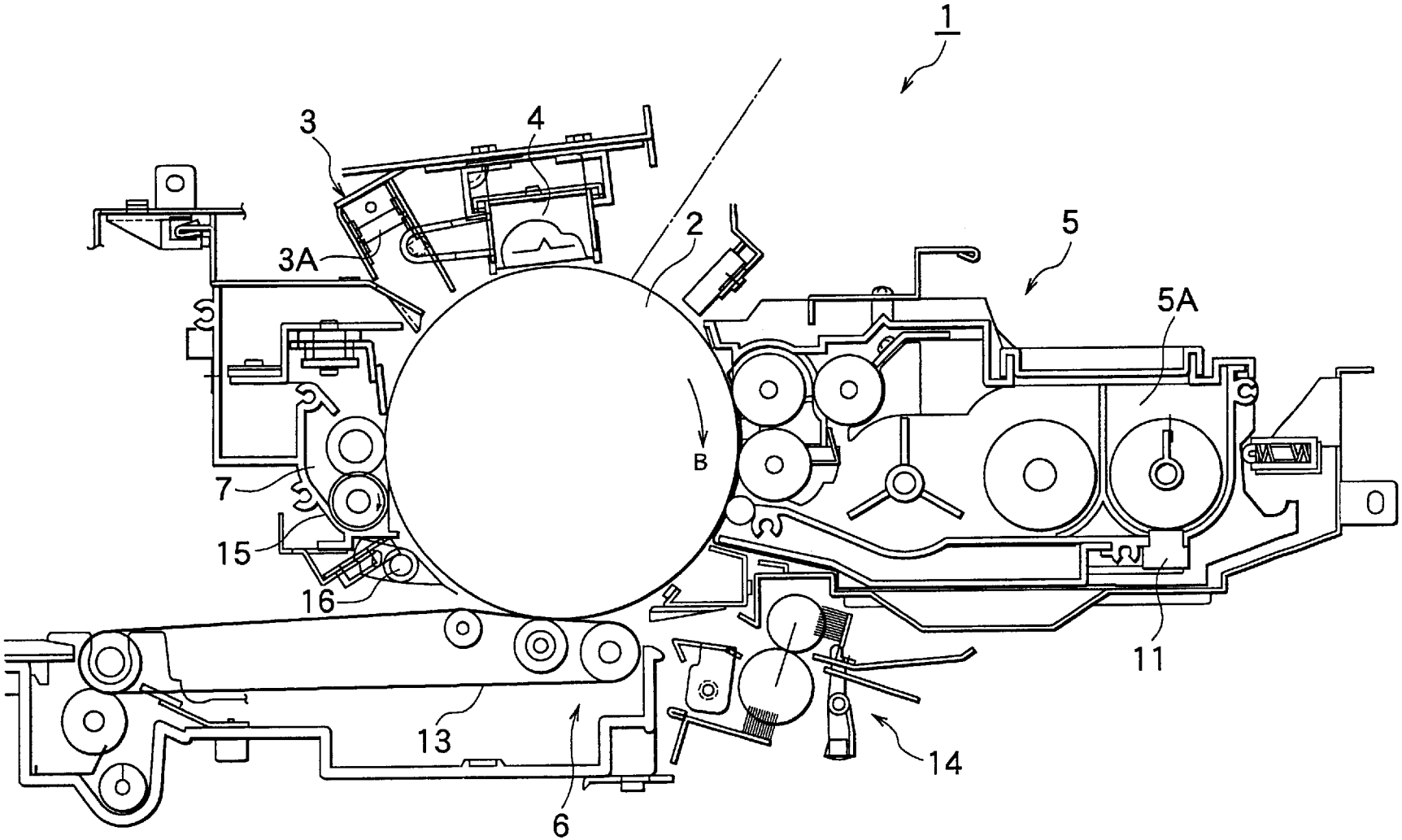
FIG. 1 is a schematic front view showing a principal part of a preferred embodiment of an image forming apparatus according to the present invention.
Figure 2:
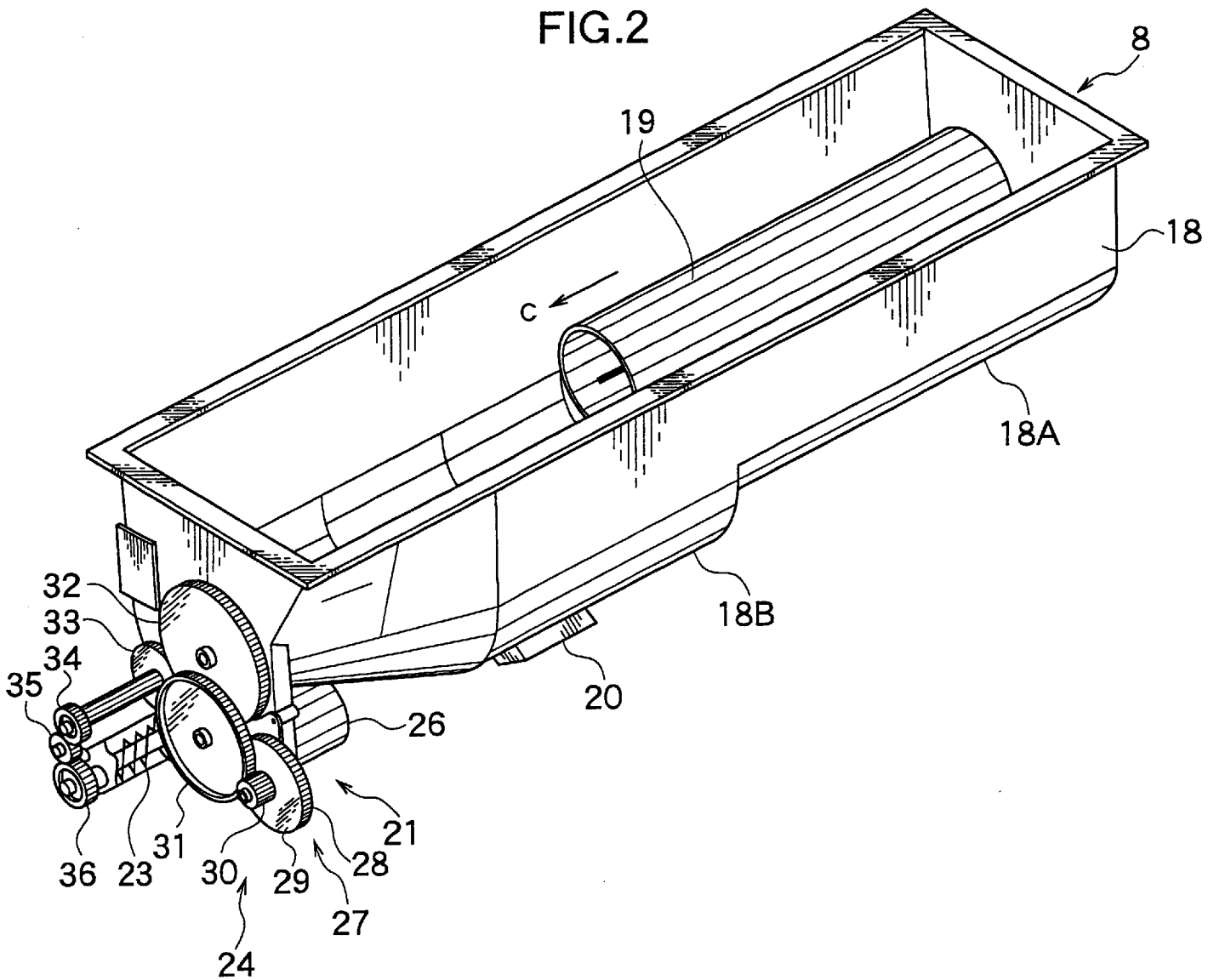
FIG. 2 is a perspective view of a preferred embodiment of a new toner supply device according to the present invention.
Figure 3:
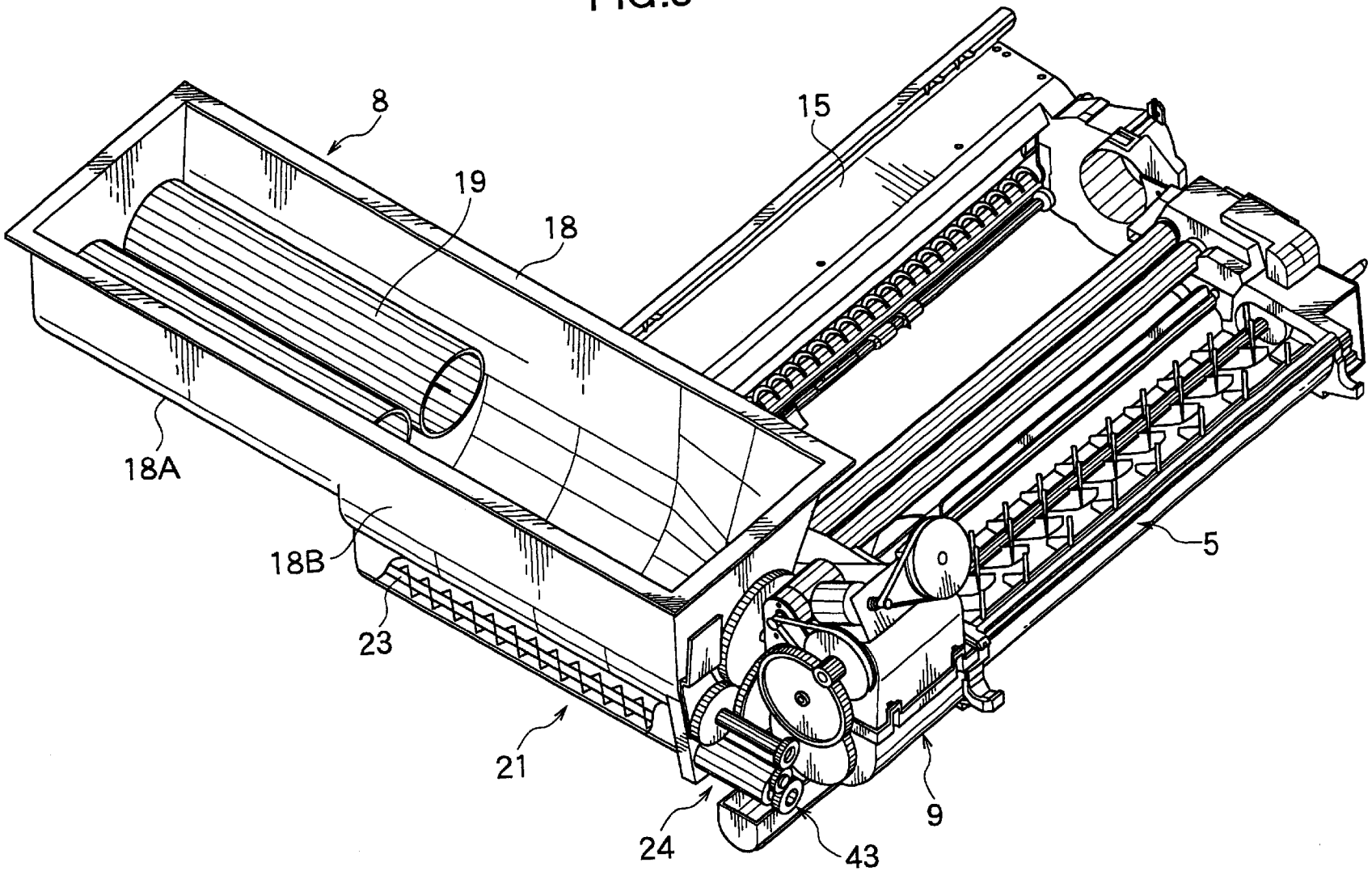
FIG. 3 is a perspective view of the image forming apparatus in the preferred embodiment.
Figure 4:
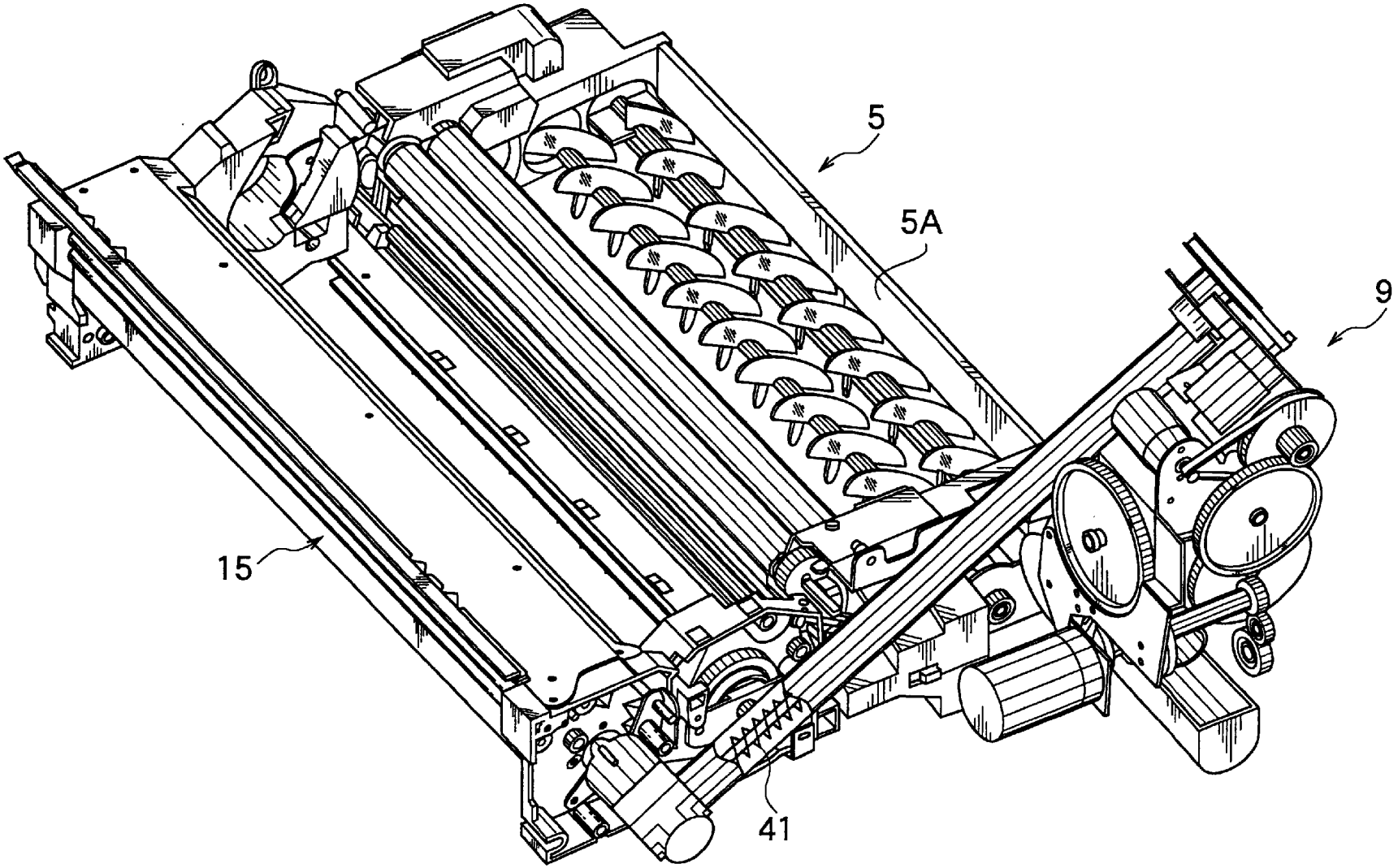
FIG. 4 is a perspective view of the image forming apparatus in the preferred embodiment, from which the new toner supply device is removed.
Figure 5:
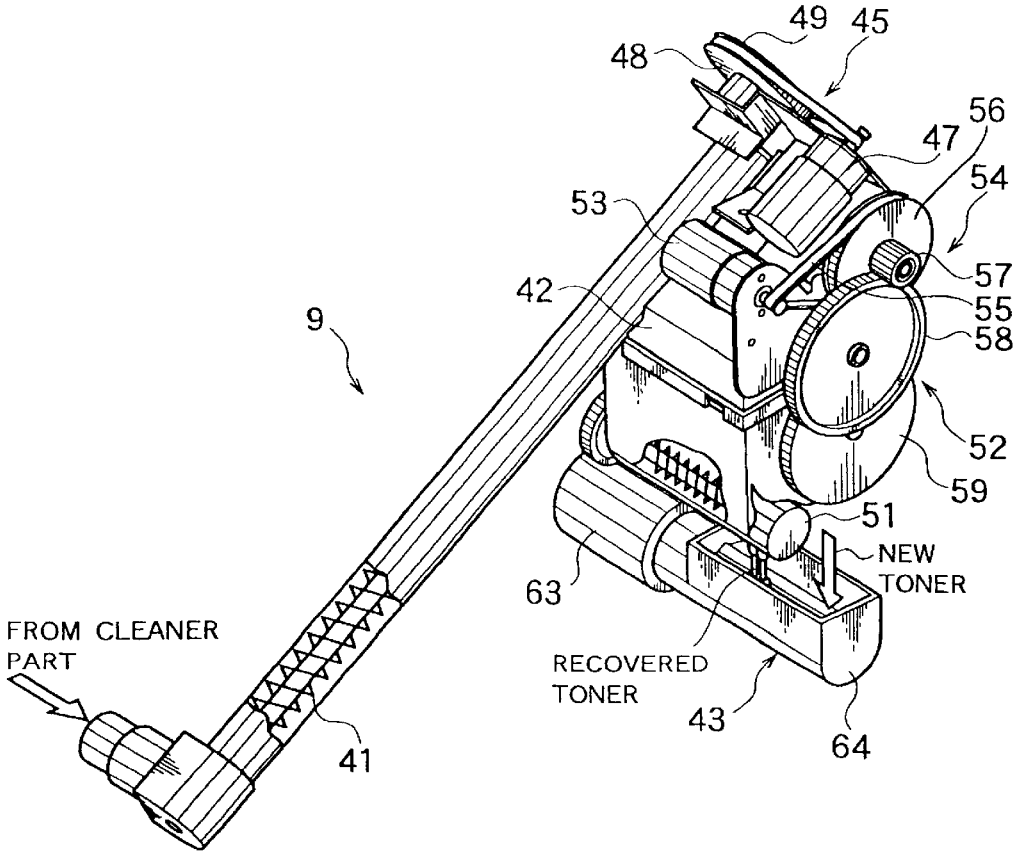
FIG. 5 is a perspective view of a preferred embodiment of a recovered toner supply device according to the present invention.
Figure 6:
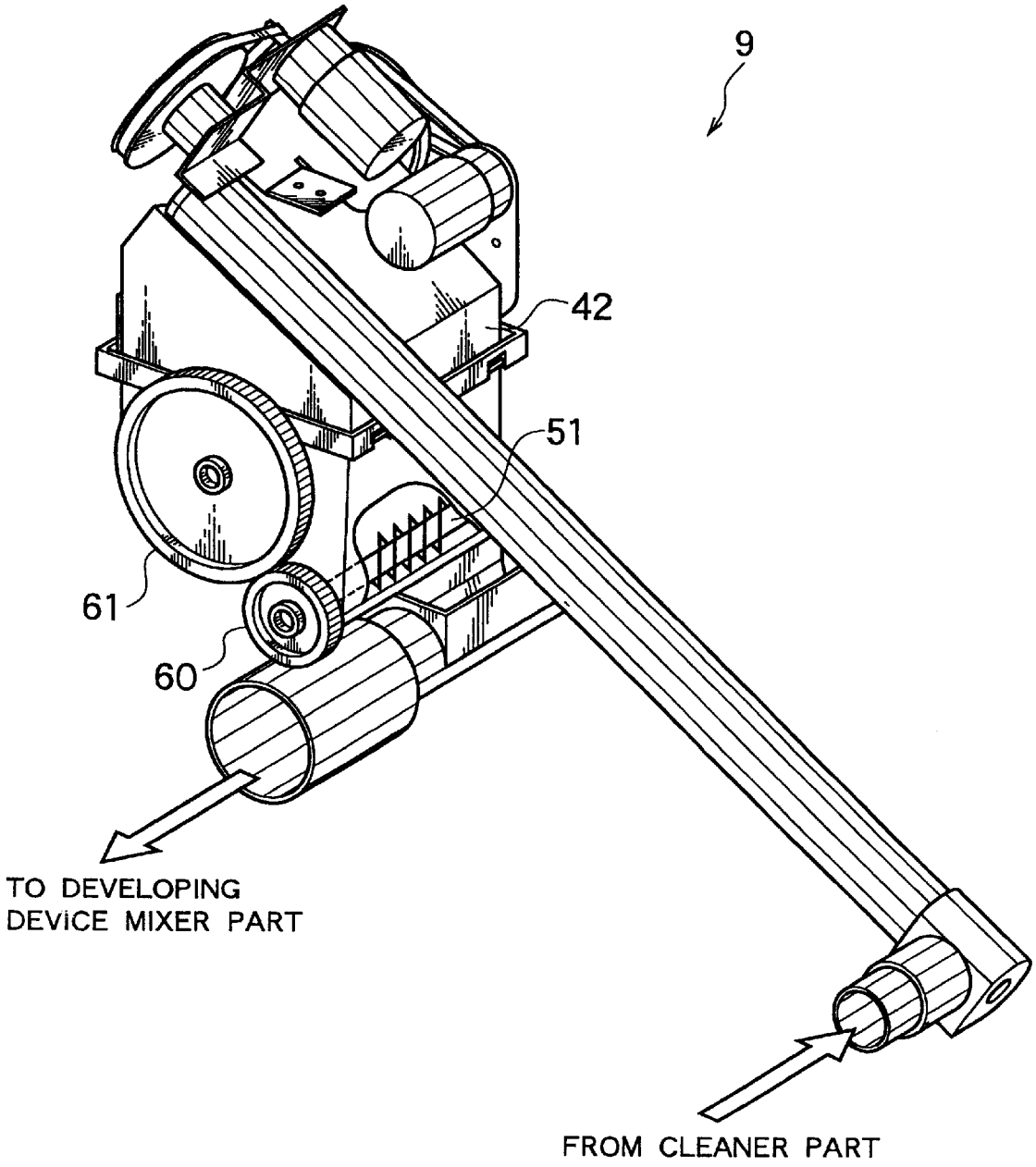
FIG. 6 is a perspective view of the recovered toner supply device in the preferred embodiment, which is viewed from a view point different from that in FIG. 5.

Referring now to FIGS. 1 through 3, the whole construction of this image forming apparatus will be described below.

The image forming apparatus 1 mainly comprises a photosensitive drum 2, a de-electrifying part 3, an electrifying charger 4, a developing device 5, a transfer part 6, a cleaner part 7, a new toner supply device 8 and a recovered toner conveying device 9.

The photosensitive drum 2 is a cylindrical drum which is designed to rotate in one direction (clockwise in FIG. 1, i.e., in a direction of arrow B). The charged state on the surface of the photosensitive drum 2 is capable of being optionally adjusted by laser beams. Thus, by suitably adjusting the charged state of an optional portion on the surface of the photosensitive drum 2, an image or the like serving as data to be transferred can be formed on the surface of the photosensitive drum 2 as a latent image.

The de-electrifying part 3 is provided for removing electrification on the surface of the photosensitive drum 2. The de-electrifying part 3 comprises a de-electrifying lamp 3A. By exposing the surface of the photosensitive drum 2 to the light of the de-electrifying lamp 3A, all of residual electric charges on the surface are removed to prepare for the next print.

The electrifying charger 4 is provided for charging the surface of the photosensitive drum 2. The surface of the photosensitive drum 2 negatively charged by the electrifying charger 4 is exposed to laser beams, which are emitted from a laser unit (not shown), to form a latent image. That is, the surface of the photosensitive drum 2 is exposed to laser beams on the basis of input information, such as an original image, so that the surface potential approaches zero in accordance with the concentration of the image or the like to form a latent image.

The developing device 5 is provided for causing an appropriate amount of toner to adhere to the surface of the charged photosensitive drum 2. Since a two-component developing system is herein adopted, the developing device 5 houses therein a carrier and a toner, the percentage of which is adjusted so as to be about 5% (% by weight) with respect to about 95% (% by weight) carrier. Specifically, the new toner supply device 8 and the recovered toner conveying device 9 are suitably controlled to adjust the percentages of the carrier and toner. The amount of the toner in the developing device 5 is always monitored by an auto toner sensor 11. If the percentage of the toner in the developing device 5 is less than 5%, the new toner supply device 8 and the recovered toner conveying device 9 are suitably controlled by a control part 70, which will be described later, to supply a required amount of toner. The supplied toner and carrier are stirred by a mixer part 5A in the developing device 5, so that negative charges are given to the toner by the frictional electrification during stirring. The negatively charged toner is absorbed onto the latent image on the surface of the photosensitive drum 2 to form a visible image.

The transfer part 6 is provided for transferring the toner, which is absorbed onto the latent image on the surface of the photosensitive drum 2, to a paper. The transfer part 6 mainly comprises a transfer belt 13 and a paper feeding part 14. The transfer belt 13 is designed to support thereon and convey a paper to cause the paper to contact the surface of the photosensitive drum 2 to transfer the visible image to the paper. The paper feeding part 14 is arranged so as to face a contact portion in which the transfer belt 13 contacts the photosensitive drum 2. The paper fed from the paper feeding part 14 to the contact portion in which the transfer belt 13 contacts the photosensitive drum 2 is positively charged to absorb the negatively charged toner which is used for forming the visible image. The paper to which the toner is transferred is fed to a fixing device (not shown) by which the toner is fixed to the paper.

The cleaner part 7 is provided for cleaning the surface of the photosensitive drum 2. The cleaner part 7 is designed to remove the toner remaining on the surface of the photosensitive drum 2 after the toner is transferred to the paper by the transfer part 6. The cleaner part 7 comprises a toner receiving part 15 and a discharging auger 16, in order to discharge the toner, which is removed from the surface of the photosensitive drum 2, to the outside. The toner removed from the surface of the photosensitive drum 2 falls to the toner receiving part 15 to be discharged toward the recovered toner conveying device 9 by means of the discharging auger 16.

The new toner supply device 8 is a device for supplying a new toner to the developing device 5. As shown in FIGS. 2 and 3, the new toner supply device 8 is arranged so as to extend in a direction perpendicular to the developing device 5. In this state, the new toner supply device 8 is installed on the front side of the body of the copying machine. The new toner supply device 8 comprises a toner housing container part 18, two stirring/conveying paddles 19, a toner residual amount detecting sensor 20 and a conveying part 21.

The toner housing container part (new toner hopper) 18 is a container for storing therein a new toner. The toner housing container part 18 comprises a substantially semi-cylindrical container, the upper side of which is open. The semi-cylindrical toner housing container part 18 is divided into a shallow-bottom portion 18A and a deep-bottom portion 18B at the center thereof in longitudinal directions. In the shallow-bottom portion 18A, the two stirring/conveying paddles 19 are provided so as to extend in parallel to each other. The deep-bottom portion 18B is provided with the toner residual amount detecting sensor 20 and the conveying part 21.

The stirring/conveying paddles 19 constitute a device for conveying the new toner, which is stored in the toner housing container part 18, to the conveying part 21 while stirring the new toner. As described above, the stirring/conveying paddles 19 are provided in the shallow-bottom portion 18A of the toner housing container part 18 so as to extend in parallel to each other. If the two stirring/conveying paddles 19 rotate, the new toner in the toner housing container part 18 is transferred to the conveying part 21 of the deep-bottom portion 18B. Each of the stirring/conveying paddles 19 is driven by a drive unit (not shown).

The toner residual amount detecting sensor 20 is a sensor for detecting the residual amount of the new toner which is stored in the toner housing container part 18. The residual amount of the new toner is always detected by the toner residual amount detecting sensor 20, since it is not possible to carry out image formation if the toner is completely consumed. As the toner residual amount detecting sensor 20, a well-known sensor, such as a magnetic sensor or an optical sensor, may be used.

The conveying part 21 is provided for supplying the new toner, which is stored in the toner housing container part 18, to the developing device 5. The conveying part 21 comprises a toner conveying auger 23 and an auger driving part 24. The toner conveying auger 23 is a screw conveyer which is provided on the bottom of the deep-bottom portion 18B so as to extend in parallel to the toner housing container part 18. The toner conveying auger 23 is arranged so as to face a toner pan part 64, which will be described later, and is designed to supply the new toner which is stored in the toner housing container part 18. The auger driving part 24 comprises a drive motor (which will be hereinafter referred to as a "toner hopper motor") 26, and a reduction gear 27. The toner hopper motor 26 comprises, e.g., a stepping motor. By controlling the rotating amount and rotating time of the toner conveying auger 23 by the toner hopper motor 26, the amount of the new toner to be supplied is precisely controlled. The reduction gear 27 comprises a belt 28, a pulley 29 and gears 30 through 36. The gears 30 through 36 are suitably adjusted in accordance with reduction ratios. On the rotation shaft of the gear 32, a stirring rod (not shown) provided on the deep-bottom portion 18B is mounted.

The recovered toner conveying device 9 is provided for conveying the recovered toner, which is recovered by the cleaner part 7, to the developing device 5 to recycle the recovered toner therein. The recovered toner conveying device 9 is arranged below the new toner supply device 8 so as to substantially extend in parallel thereto. As shown in FIGS. 3 through 6, the recovered toner conveying device 9 comprises a recovered toner connecting/conveying auger 41, a recovered toner sub-hopper 42 and a supply auger 43.

The recovered toner connecting/conveying auger 41 is provided for conveying the recovered toner, which is recovered by the cleaner part 7, toward the developing device 5. The recovered toner connecting/conveying auger 41 comprises, e.g., a long screw conveyer. The bottom end portion of the recovered toner connecting/conveying auger 41 is connected to the discharging auger 16 of the cleaner part 7, and the top end portion thereof is connected to the recovered toner sub-hopper 42. The driving part 45 of the recovered toner connecting/conveying auger 41 comprises a drive motor 47 which is provided adjacent to the top end portion of the recovered toner connecting/conveying auger 41, a pulley 48 which is connected to the recovered toner connecting/conveying auger 41, and a belt 49 which connects the drive motor 47 to the pulley 48. The drive motor 47 is controlled so as to be connected with the drive motor of the discharging auger 16.

The recovered toner sub-hopper 42 is a container for temporarily storing the recovered toner, which is recovered by the recovered toner connecting/conveying auger 41, to feed the required amount of the recovered toner to the developing device 5. In the recovered toner sub-hopper 42, there is provided a stirring rod (not shown) for stirring the recovered toner which is stored therein. In the lower portion in the recovered toner sub-hopper 42, a recovered toner supply auger 51 is provided. The rotation of the recovered toner supply auger 51 is controlled by a driving part 52, so that the recovered toner supply auger 51 is designed to supply a precise amount of recovered toner to the supply auger 43. The driving part 52 comprises a drive motor 53 and a reduction gear 54. The drive motor 53 comprises, e.g., a stepping motor. The reduction gear 54 comprises a belt 55, a pulley 56 and gears 57 through 61 which are combined with each other. The gears 59 and 60 are provided on both sides of the recovered toner sub-hopper 42 to be connected to each other by means of a single rotation shaft which is provided with a stirring rod (not shown).

The supply auger 43 is provided for receiving the recovered toner and the new toner from the recovered toner supply auger 51 and the toner conveying auger 23 of the new toner supply device 8, respectively, to supply them into the developing device 5. The supply auger 43 comprises an auger part 63 which is provided so as to extend from the mixer part 5A of the developing device 5, and a toner pan part 64 which is open to the recovered toner supply auger 51 and the toner conveying auger 23. The drive motor (not shown) of the auger part 63 is provided on the side of the developing device 5. The recovered toner supply auger 51 is provided on the side of the developing device 5. In the toner pan part 64, the new toner from the toner conveying auger 23 of the new toner supply device 8 is supplied upstream of the recovered toner from the recovered toner supply auger 51.

Figure 7:
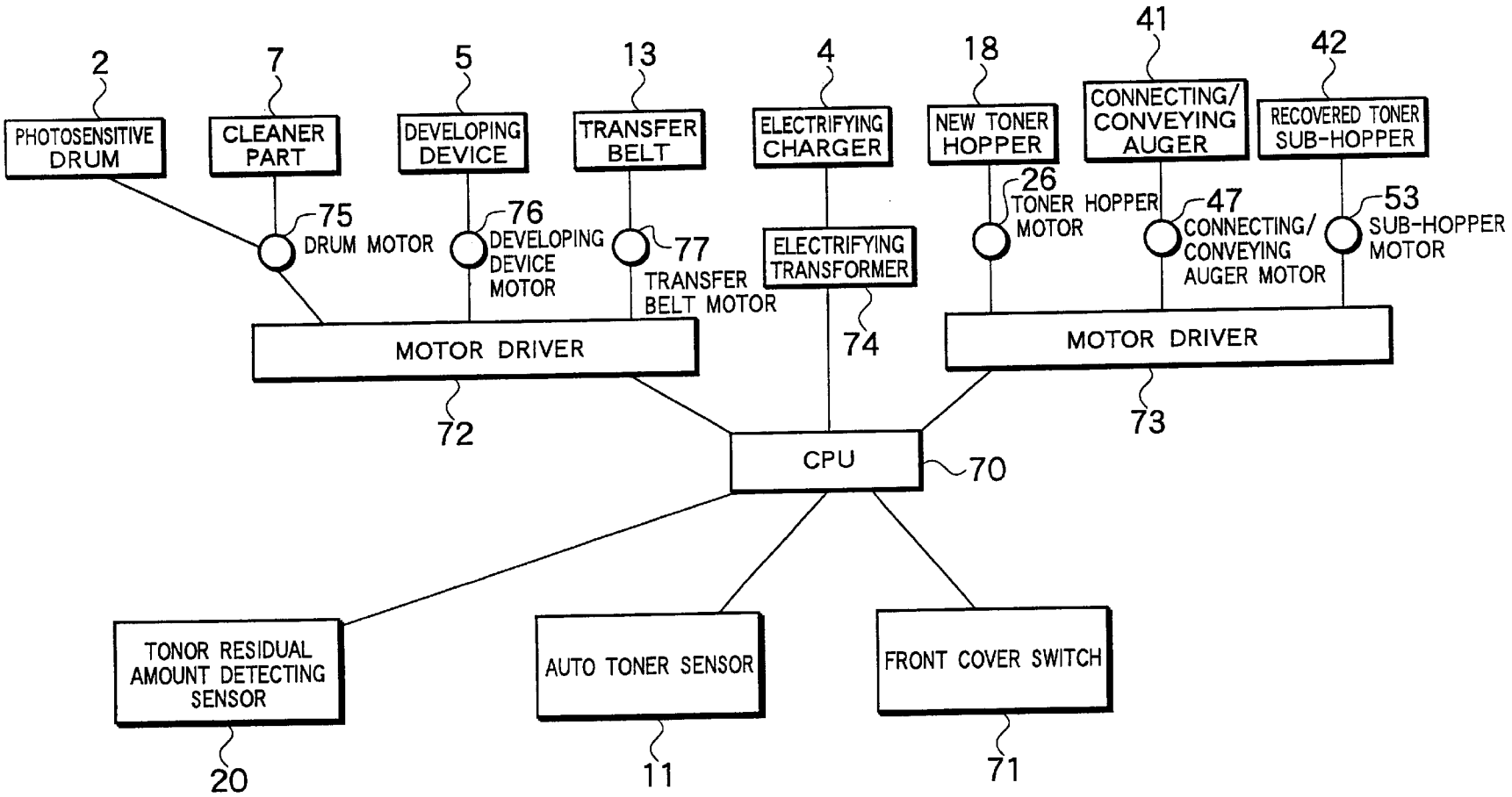
FIG. 7 is a block diagram showing the control construction of the image forming apparatus in the preferred embodiment.

FIG. 7 is a block diagram showing the control construction of the image forming apparatus 1 in this preferred embodiment.

A control part (shown by CPU in FIG. 7) 70 comprises, e.g., a CPU, ROM and RAM, and is designed to control the whole image forming apparatus 1 on the basis of a processing program, which is stored in the ROM and RAM, and in accordance with data and the outputs of various sensors, which are stored in the ROM and RAM.

The input port of the control part 70 is connected to the above described toner residual amount detecting sensor 20 and auto toner sensor 11, and to a front cover switch 71.

As described above, the toner residual amount detecting sensor 20 is designed to detect the residual amount of the new toner in the new toner hopper 18. For example, as the toner residual amount detecting sensor 20, a magnetic sensor comprising a magnet and a reed switch may be used. When the residual amount of the new toner is large, the new toner enters between the magnet and the reed switch to form a gap therebetween to turn the reed switch off. On the other hand, when the residual amount of the new toner is small, the gap disappears, so that the reed switch is turned on by the attraction of the magnet. Such on/off of the reed switch is detected by the control part 70.

As described above, the auto toner sensor 11 is a toner concentration ratio sensor for detecting the ratio of the carrier (iron) to the toner (resin) in the developer. The output of the auto toner sensor 11 is read by the control part 70. If the concentration of the toner decreases, the control part 70 is designed to drive the toner hopper motor 26 and so forth to supply the toner to the developing device 5, and to display no toner on a control panel (not shown) to inform the user of it.

The front cover switch 71 is a switch which is turned off/on by the opening/closing of a body cover (which is herein assumed as a front cover) of the copying machine. The control part 70 reads the output signal of the front cover switch 71 to recognize the state of the front cover.

The output port of the control part 70 is connected to two motor drivers 72, 73 and an electrifying transformer 74.

The photosensitive drum 2 and the cleaner part 7 are driven by the drum motor 75, which is rotated by a motor driver 72, under the control of the control part 70 during a copying operation or the like.

Similarly, the developing device 5 and the transfer belt 13 are driven by a developing device motor 76 and a transfer belt motor 77, respectively, which are rotated by the motor driver 72, under the control of the control part 70 during a copying operation or the like.

Similarly, the new toner hopper 18, the connecting/conveying auger 41 and the recovered toner sub-hopper 42 are driven by the toner hopper motor 26, the connecting/conveying auger motor 47 and the sub-hopper motor 53, respectively, which are rotated by the motor driver 73.

Furthermore, although the toner hopper motor 26, the connecting/conveying auger motor 47 and the sub-hopper motor 53 are connected to the same motor driver 73, these motors can be separately driven by the control of the control part 70.

As described above, during a copying operation or the like, a high voltage is applied to the electrifying charger 4 by the electrifying transformer 74 under the control of the control part 70, so that the electrifying charger 4 electrifies the photosensitive drum 2.

Referring to the flow chart of FIG. 8, the schematic image forming operation (image forming method) in the image forming apparatus in this preferred embodiment will be described below.

Figure 8:
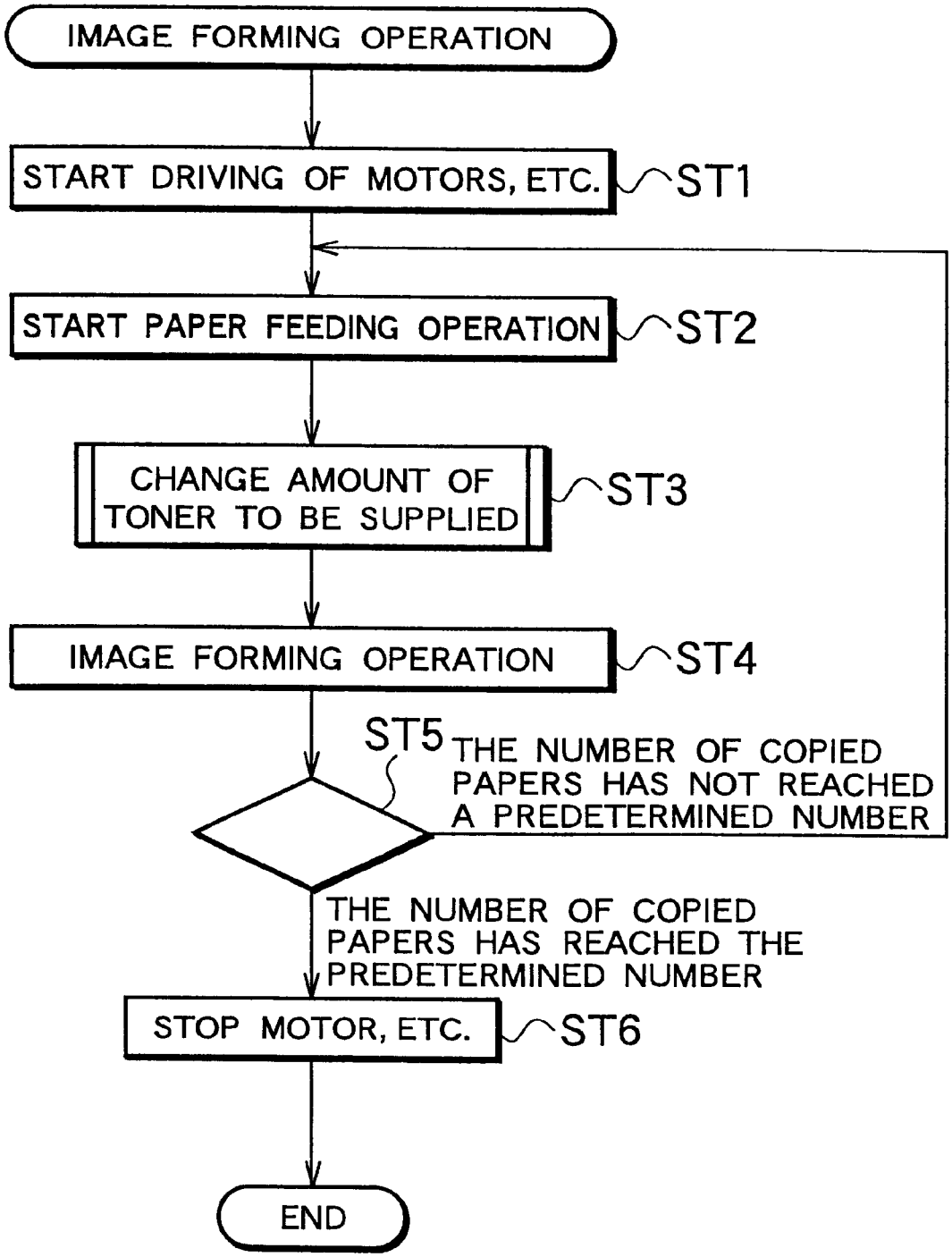
FIG. 8 is a flow chart showing an image forming operation in the preferred embodiment of an image forming apparatus according to the present invention.

In FIG. 8, if a copying operation (image forming operation) is started by a keying part (not shown), the control part 70 carries out a drive starting process for various motors (ST1).

Figure 9:
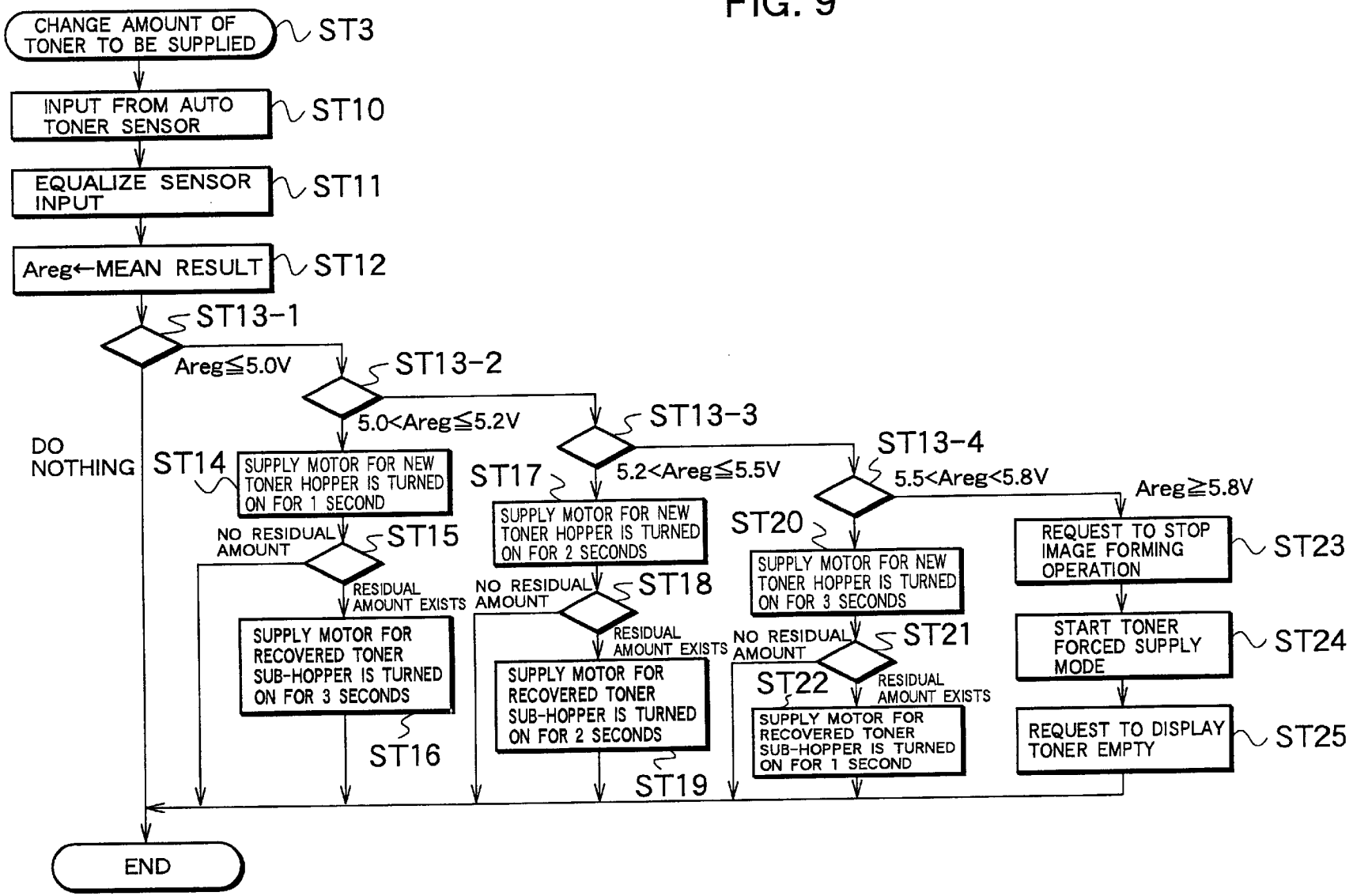
FIG. 9 is a flow chart showing a toner supply amount changing control process in FIG. 8.

Thereafter, a process for each paper is carried out. That is, the control part 70 causes to start a paper feeding operation (ST2), and carries out a toner supply amount changing control (ST3), the details of which are shown in FIG. 9. Then, the control part 70 causes to execute a concrete image forming operation (ST4).

After such a process for each paper is completed, the control part 70 determines whether the number of copied papers reaches a predetermined number (ST5). If the number of copied papers has not reached the predetermined number, the routine returns to the above described step ST2. On the other hand, if the number of copied papers has reached the predetermined number, the control part 70 causes to execute a stopping process for various motors (ST6).

Referring to the flow chart of FIG. 9, the details of the toner supply amount changing control process at the above described step ST3 will be described below.

The new toner has been stored in the new toner hopper 18, and the recovered toner recovered by a cleaner auger part (not shown) has been conveyed by the connecting/conveying auger 41 to be stored in the recovered toner sub-hopper 42.

The toner supply control to the developing device 5 is basically carried out when the toner specific concentration to the developer, which is detected by the auto toner sensor (toner concentration ratio sensor) 11 provided in relation to the developing device 5, is less than a reference concentration.

In the toner supply amount changing control process shown in FIG. 9, the control part 70 first inputs an output voltage from the auto toner sensor 11 (ST10), to equalize the inputted voltage in order to remove the influence of noises and so forth (ST11), and sets the mean result as a toner concentration ratio parameter Areg (ST12).

Furthermore, in the following descriptions, it is assumed that the output voltage of the auto toner sensor 11 increases as the toner concentration ratio decreases. It is also assumed that the new toner hopper 18 and the recovered toner sub-hopper 42 have the same supply capacity when being driven for the same period of time, as will be described later.

If the control part 70 obtains the toner concentration ratio parameter Areg, the control part 70 determines its stage (ST13-1 through ST13-4).

When the toner concentration ratio parameter Areg is 5.0 V or less, i.e., when the toner concentration in the developer is a reference concentration or higher, the control part 70 ends the process shown in FIG. 9 without causing to supply toner from the new toner hopper 18 and recovered toner sub-hopper 42. That is, both of the new toner and the recovered toner are not supplied to the developing device 5.

When the toner concentration ratio parameter Areg is higher than 5.0 V and lower than or equal to 5.2 V, i.e., when the toner concentration in the developer is slightly lower than the reference concentration, the control part 70 first causes the toner hopper motor 26, which causes to supply the new toner in the new toner hopper 18 to the developing device 5, to be turned on only for 1 second to supply the new toner to the developing device 5 (ST14).

Then, the control part 70 determines whether the output of the toner residual amount detecting sensor 20 is indicative of no residual amount in the new toner hopper 18 (ST15). If it is indicative of residual amount, the control part 70 causes the sub-hopper motor 53, which causes to supply the recovered toner in the recovered toner sub-hopper 42 to the developing device 5, to be turned on only for 3 seconds to supply the recovered toner to the developing device 5 (ST16). On the other hand, if it is indicative of no residual amount, the routine in FIG. 9 ends without driving the sub-hopper motor 53.

When the toner concentration ratio parameter Areg is higher than 5.2 V and lower than or equal to 5.5 V, i.e., when the toner concentration in the developer is intermediately lower than the reference concentration, the control part 70 first causes the toner hopper motor 26, which causes to supply the new toner in the new toner hopper 18 to the developing device 5, to be turned on only for 2 seconds to supply the new toner to the developing device 5 (ST17).

Then, also in this toner concentration ratio stage, the control part 70 determines whether the output of the toner residual amount detecting sensor 20 is indicative of no residual amount in the new toner hopper 18 (ST18). If it is indicative of residual amount, the control part 70 causes the sub-hopper motor 53, which causes to supply the recovered toner in the recovered toner sub-hopper 42 to the developing device 5, to be turned on only for 2 seconds to supply the recovered toner to the developing device 5 (ST19). On the other hand, if it is indicative of no residual amount, the routine in FIG. 9 ends without driving the sub-hopper motor 53.

When the toner concentration ratio parameter Areg is higher than 5.5 V and lower than 5.8 V, i.e., when the toner concentration in the developer is much lower than the reference concentration, the control part 70 first causes the toner hopper motor 26, which causes to supply the new toner in the new toner hopper 18 to the developing device 5, to be turned on only for 3 seconds to supply the new toner to the developing device 5 (ST20).

Then, also in this toner concentration ratio stage, the control part 70 determines whether the output of the toner residual amount detecting sensor 20 is indicative of no residual amount in the new toner hopper 18 (ST21). If it is indicative of residual amount, the control part 70 causes the sub-hopper motor 53, which causes to supply the recovered toner in the recovered toner sub-hopper 42 to the developing device 5, to be turned on only for 1 second to supply the recovered toner to the developing device 5 (ST22). On the other hand, if it is indicative of no residual amount, the routine in FIG. 9 ends without driving the sub-hopper motor 53.

When the toner concentration ratio parameter Areg is 5.8 V or more, i.e., when the toner concentration in the developer is such a concentration that the toner can not be utilized for image formation, the control part 70 issues a request to stop the image forming operation to the respective parts (ST23), starts a process in a mode in which the new toner is forced to be supplied (ST24), and requests a display part (not shown) to display a toner empty (ST25).

As described above, if no residual amount of the new toner in the new toner hopper 18 is detected, the supply of the recovered toner to the developing device 5 is not carried out.

The reasons why the toner supply amount changing control process is carried out as shown in FIG. 9 will be described below.

As the number of copying operations increases, the amount of consumed toner increases. Therefore, in general, the toner concentration in the developer decreases, and the toner concentration ratio parameter Areg gradually increases. That is, if the new toner in the new toner hopper 18 is completely consumed to decrease the amount of toner to be supplied to the developing device 5, the developer toner specific concentration in the developing device 5 is gradually decreased by the image forming operation, so that the output voltage of the auto toner sensor 11 gradually increases from the reference voltage of 5.0 V. Then, when the toner specific concentration is lower than the reference concentration by about 1% by weight, the output voltage of the auto toner sensor 11 is 5.8 V. This is regarded as the empty state of the new toner. Then, as described above, the toner empty is displayed so that the user can recognize it. Simultaneously, the image forming operation is stopped.

Even before the stage regarded as the empty state of the new toner as described above, the times required to drive the new toner and recovered toner supplying hoppers 18 and 42 are controlled in accordance with the toner concentration ratio to carry out an operation for causing the toner concentration ratio to return to the reference concentration.

In this preferred embodiment, as described above, if the toner residual amount detecting sensor 20 provided in the new toner hopper 18 detects that the new toner is completely consumed, the supply of the recovered toner from the recovered toner sub-hopper 42 is stopped. The effects obtained by this will be described below.

Figure 10:
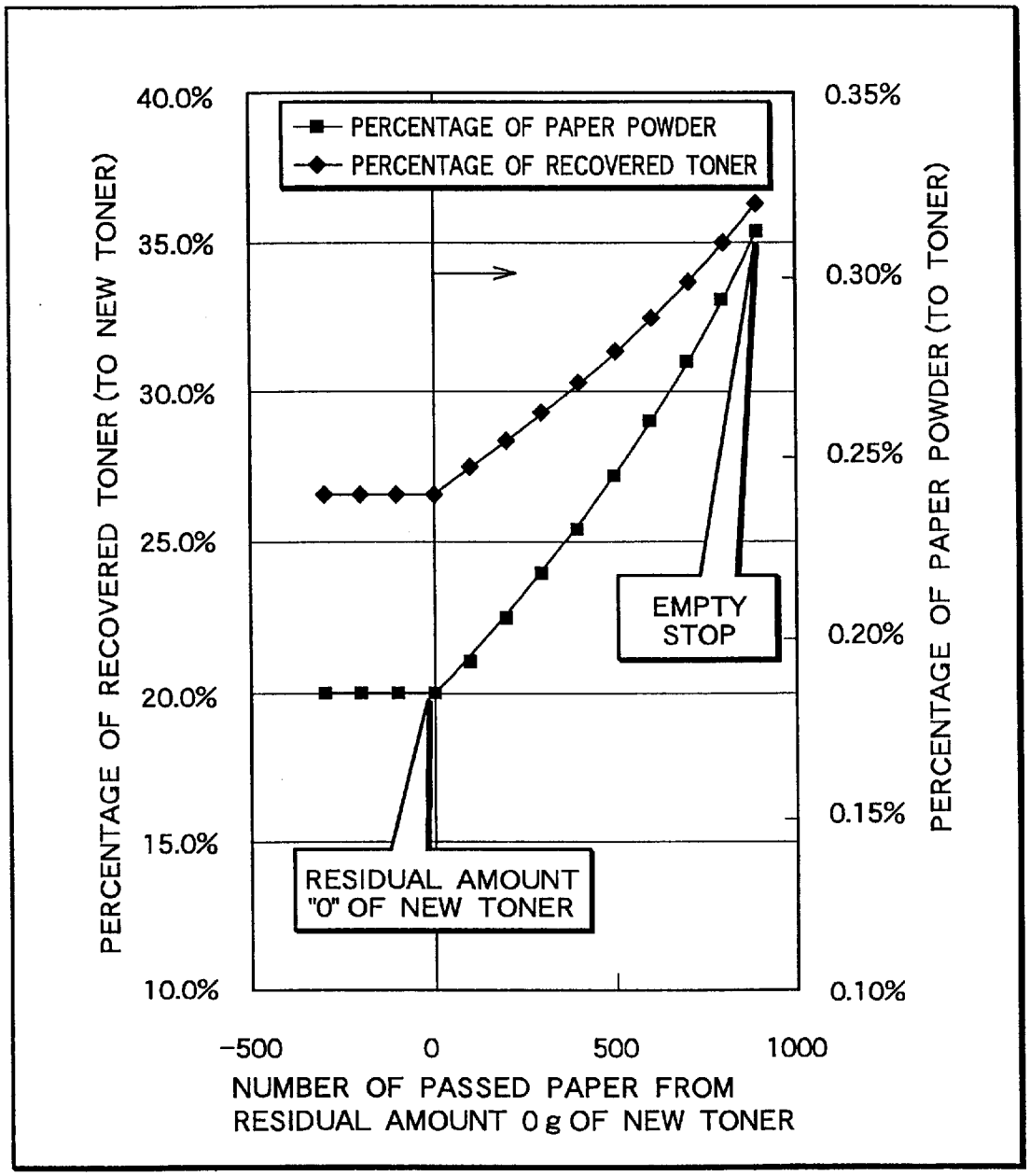
FIG. 10 is a graph showing the variation in percentage of recovered toner and the variation in percentage of paper powder in the prior art wherein the recovered toner is supplied when a new toner does not remain.

FIG. 10 shows the variations in percentage of recovered toner and in percentage of paper powder in a developing device until an empty stop after a new toner is completely consumed, in the prior art wherein the recovered toner supply control is not carried out.

As shown in FIG. 10, if the recovered toner is directly returned, the recovered toner is supplied even after the new toner in the new toner hopper is completely consumed, so that the percentage of the recovered toner in the developing device increases. Simultaneously, paper powder produced from papers, together with toner, is recovered by the cleaner part to be fed into the developing device. Therefore, even after the new toner in the new toner hopper is completely consumed, the paper powder, together with the recovered toner, is continuously fed into the developing device, so that the percentage of paper powder also increases.

It is well know that the external additive adhering to toner particles as an electrification control agent has been peeled from the recovered toner itself in comparison with the new toner. It is also well known that, if the recovered toner having no external additive is supplied to the developing device, image fogging occurs due to the decrease of the quantity of electrification. It is also well known that, if paper powder produced from papers enters the developing device, fiber-like fogging occurs, and the electrification of the developer is inhibited by additives included in papers.

That is, it is not desired that the amount of recovered toner and the amount of paper powder thus remarkably increase in the developing device.

Figure 11:
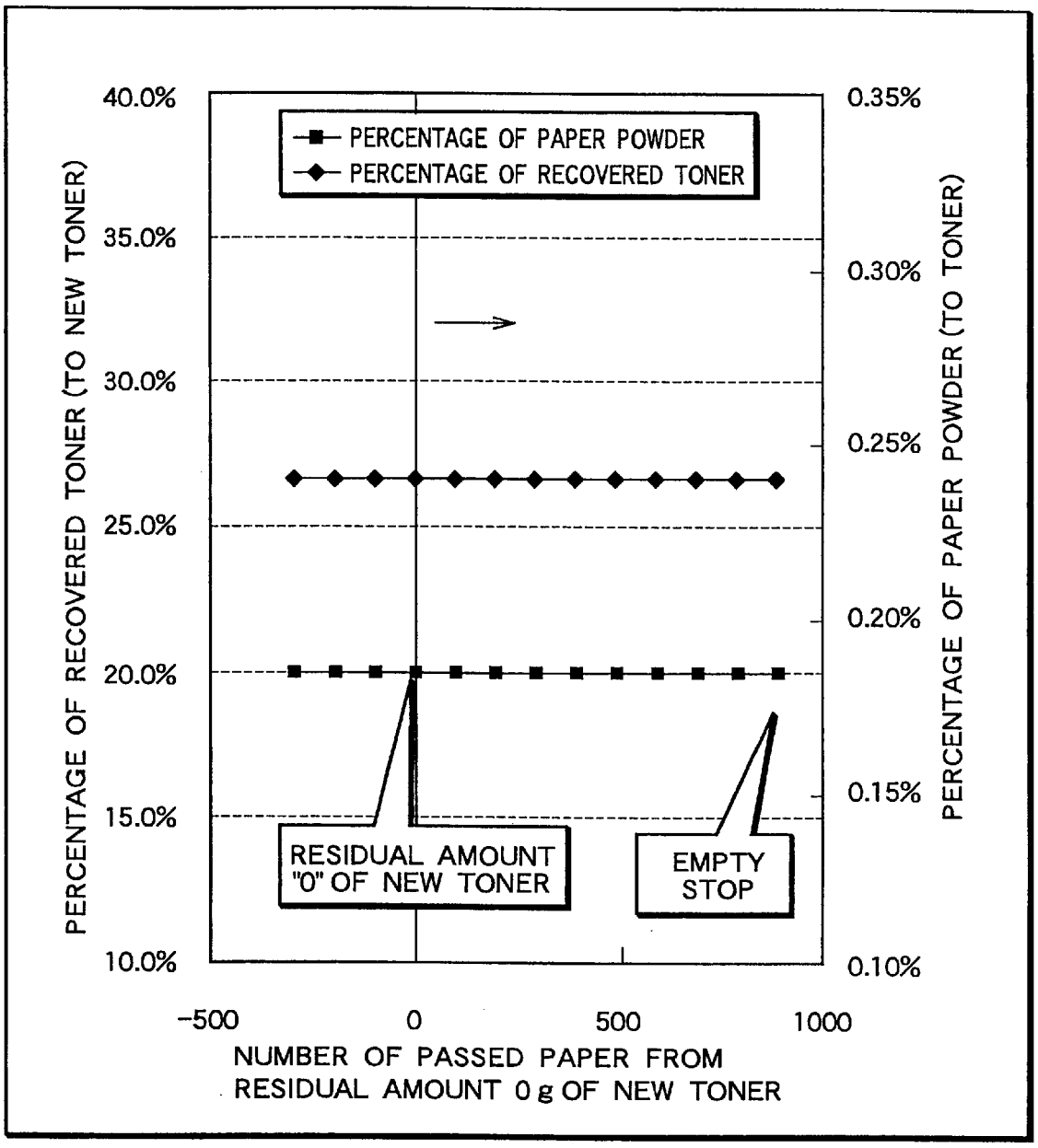
FIG. 11 is a graph showing the variation in percentage of recovered toner and the variation in percentage of paper powder in the preferred embodiment wherein the recovered toner is not supplied when a new toner does not remain.

FIG. 11 shows the variations in percentage of recovered toner and in percentage of paper powder in a developing device until an empty stop after a new toner is completely consumed, in this preferred embodiment.

In the preferred embodiment, the supply of the recovered toner is stopped when the new toner is completely consumed. Therefore, the percentage of the recovered toner and the amount of paper powder do not increase in the developing device 5 unlike the prior art, so that it is possible to carry out image formation, which does not have discrepancy, such as image fogging, even near toner empty.

Unlike FIG. 9, when the new toner is completely consumed, a smaller amount of recovered toner than that in usual operations may be supplied if it is such an extent that discrepancy is not caused. For example, when the result of no residual amount of new toner is obtained by the determination at steps ST15, ST18 and ST21 in FIG. 9, the time required to supply the recovered toner may be·(0 . . . 1) times as long as the supply time when the new toner remains (steps ST16, ST19 and ST22).

In such a case, the recovered toner is slightly supplied into the developing device 5 even if the new toner is completely consumed, so that it is possible to increase the number of passed papers until the stop of the image forming operation due to toner empty.

Figure 12:
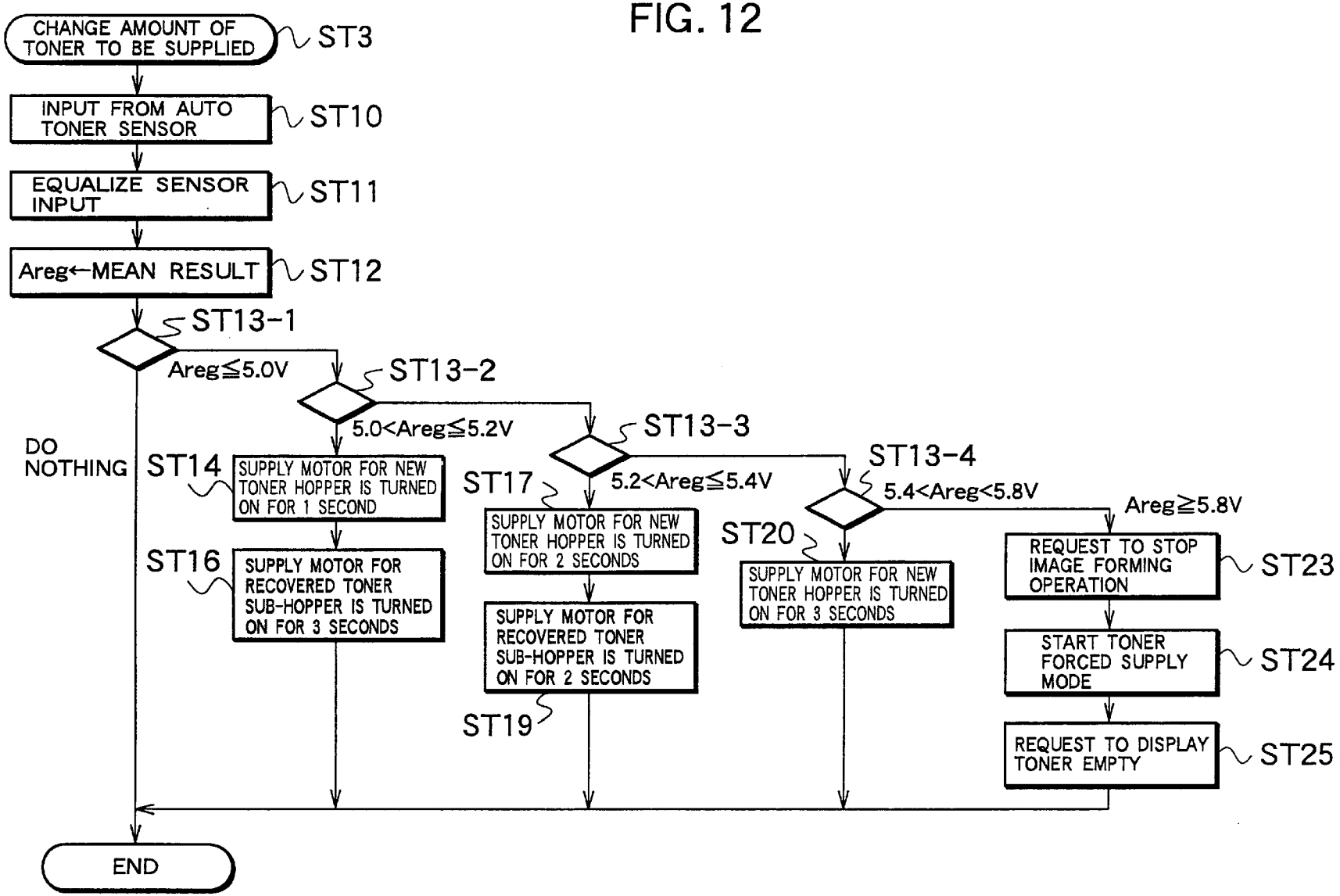
FIG. 12 is a flow chart showing another example of a toner supply amount changing control process in FIG. 8.

FIG. 12 is a flow chart showing a toner supply amount changing control (ST3) in another preferred embodiment of the present invention. In this figure, the same reference numbers are given to the same or corresponding steps as or to the above described steps in FIG. 9.

In the process shown in FIG. 12, the output of the toner residual amount detecting sensor 20 is not utilized for carrying out the supply amount control.

In this process, when the output voltage (mean voltage) of the auto toner sensor 11 exceeds 5.4 V, the new toner is regarded as having been completely consumed, and the supply of the recovered toner is not carried out. Furthermore, if the time to supply the new toner is 3 seconds, the recovered toner is not supplied although the time to supply the recovered toner is preferably 1 second. However, the recovered toner may be supplied for a shorter period of time than 1 second.

As described above, in the above described two preferred embodiments, no residual amount of the new toner is determined on the basis of the output of the toner residual amount detecting sensor 20 or falsely determined on the basis of the output of the auto toner sensor 11. At this point, these preferred embodiments are different. However, in either preferred embodiment, if the new toner is completely consumed, the supply of the recovered toner is not carried out (or the amount of recovered toner to be supplied is less than the usual amount even if the supply of the recovered toner is carried out).

The reason why the supply of the recovered toner is not carried out (or the amount of recovered toner to be supplied is less than the usual amount even if the supply of the recovered toner is carried out) when the new toner is completely consumed if no residual amount of the new toner is also falsely determined on the basis of the output of the auto toner sensor 11, has been described above.

According to each of the above described preferred embodiments, when the new toner is completely consumed, the supply of the recovered toner is stopped or the amount of the recovered toner to be supplied is decreased. Therefore, the percentage of the recovered toner and the amount of paper powder do not increase in the developing device 5 unlike the prior art, so that it is possible to carry out image formation, which does not have discrepancy, such as image fogging, even near toner empty.

In the above described preferred embodiment, the supply of the recovered toner is restricted regardless of the size of papers used for image formation. However, the amount of the recovered toner to be restricted may be changed in accordance with the size of papers used for image formation.

In the above described preferred embodiment, the new toner supply construction is not a cartridge construction. However, the present invention can be applied to a case where the new toner supply construction is a cartridge construction.

The image forming apparatus and method according to the present invention can not only be applied to copying machines, but they can be also applied to other apparatuses, such as printers and facsimiles, which use a photosensitive drum for carrying out image formation.

What is claimed is:

1. An image forming apparatus comprising:

recovered toner housing means for temporarily storing therein a recovered toner;

a connecting/conveying device for conveying said recovered toner from a cleaner part to said recovered toner housing means;

recovered toner supply means for supplying said recovered toner, which is housed in said recovered toner housing means, to a developing device;

new toner housing means for housing therein a new toner;

new toner supply means for supplying said new toner, which is stored in said new toner housing means, to said developing device;

no-residual-amount detecting means for detecting no residual amount of said new toner in said new toner housing means after said new toner supply means supplies said new toner to said developing device; and control means for separately controlling said recovered toner supply means and said new toner supply means, to cause said recovered toner or said new toner to be supplied to said developing device, wherein said control means commands the supply of said recovered toner from said recovered toner housing means to said developing device if said no-residual-amount detecting means detects a residual amount of said new toner in said new toner housing means, and restricts the supply of said recovered toner from said recovered toner housing means to said developing device when said no-residual-amount detecting means detects no residual amount of said new toner.

2. An image forming apparatus as set forth in claim 1, wherein the restriction of the supply of said recovered toner carried out by said control means when said no-residual-amount detecting means detects no residual amount of said new toner is the stop of the supply of said recovered toner.

3. An image forming apparatus as set forth in claim 1, wherein the restriction of the supply of said recovered toner carried out by said control means when said no-residual-amount detecting means detects no residual amount of said new toner is the decrease of the amount of said recovered toner to be supplied.

4. An image forming apparatus as set forth in claim 1, wherein said no-residual-amount detecting means is a sensor for directly detecting the residual amount of said new toner in said new toner housing means.

5. An image forming apparatus as set forth in claim 1, wherein said no-residual-amount detecting means indirectly detects no residual amount of said new toner in said new toner housing means, on the basis of an output of toner concentration ratio detecting means for detecting a toner concentration ratio in said developing device.

6. An image forming method for causing a connecting/conveying device to convey a recovered toner from a cleaner part to a recovered toner housing means to house therein said recovered toner, and causing control means to separately control a recovered toner supply means and a new toner supply means to supply said recovered toner, which is stored in said recovered toner housing means, and/or a new toner, which is stored in a new toner housing means, to a developing device, comprising:

supplying said new toner from said new toner housing means to said developing device with said new toner supply means;

detecting no residual amount of said new toner in said new toner housing means with no-residual amount detecting means after supplying new toner to said new toner supply means;

supplying said recovered toner from said recovered toner housing means to said developing device if said no-residual-amount detecting means detects a residual amount of said new toner in said new toner housing means; and restricting the supply of said recovered toner from said recovered toner housing means to said developing device if said no-residual-amount detecting means detects no residual amount of said new toner in said new toner housing means.

7. An image forming method as set forth in claim 6, wherein the restriction of the supply of said recovered toner carried out by said control means when said no-residual-amount detecting means detects no residual amount of said new toner is the stop of the supply of said recovered toner.

8. An image forming method as set forth in claim 6, wherein the restriction of the supply of said recovered toner carried out by said control means when said no-residual-amount detecting means detects no residual amount of said new toner is the decrease of the amount of said recovered toner to be supplied.

9. An image forming method as set forth in claim 6, wherein said no-residual-amount detecting means is a sensor for directly detecting the residual amount of said new toner in said new toner housing means.

10. An image forming method as set forth in claim 6, wherein said no-residual-amount detecting means indirectly detects no residual amount of said new toner in said new toner housing means, on the basis of an output of toner concentration ratio detecting means for detecting a toner concentration ratio in said developing device.

* * * * *